US007930991B2

(12) United States Patent
Northrup et al.

(10) Patent No.: US 7,930,991 B2
(45) Date of Patent: Apr. 26, 2011

(54) ADJUSTABLE FILM APPLICATOR

(75) Inventors: William Northrup, North Fort Myers, FL (US); James Fusco, Fort Lauderdale, FL (US)

(73) Assignee: Paul N. Gardner Company Incorporated, Pompano Beach, FL (US)

( * ) Notice: Subject to any disclaimer, the term of this patent is extended or adjusted under 35 U.S.C. 154(b) by 1105 days.

(21) Appl. No.: 11/582,562

(22) Filed: Oct. 18, 2006

(65) Prior Publication Data

US 2007/0151511 A1 Jul. 5, 2007

Related U.S. Application Data

(60) Provisional application No. 60/727,547, filed on Oct. 18, 2005.

(51) Int. Cl.
*B05C 17/10* (2006.01)

(52) U.S. Cl. ..... 118/100; 118/200; 118/256; 15/245.1; 15/235.8; 30/329

(58) Field of Classification Search ..... 15/245.1, 15/235.4, 235.8, 235.6; 118/100, 200, 256, 118/108; 425/458; 401/5, 266; 30/329
See application file for complete search history.

(56) References Cited

U.S. PATENT DOCUMENTS

| | | | | |
|---|---|---|---|---|
| 3,882,817 | A * | 5/1975 | Zink | 118/126 |
| 4,804,321 | A * | 2/1989 | Riesgo | 425/87 |
| 5,117,767 | A * | 6/1992 | Sommer | 118/126 |
| 6,395,089 | B1 * | 5/2002 | Houston | 118/413 |

* cited by examiner

*Primary Examiner* — Laura Edwards
(74) *Attorney, Agent, or Firm* — WRB-IP LLP; David J. Serbin

(57) ABSTRACT

A film applicator which includes an applicator housing, an applicator blade positioned within the housing, a micrometer secured to the applicator housing and having a plurality of shafts and a plurality of magnets each having one end secured to a respective micrometer shaft and another end in releasable magnetic engagement with the applicator blade.

11 Claims, 1 Drawing Sheet

ADJUSTABLE FILM APPLICATOR

CROSS REFERENCE TO RELATED APPLICATIONS

This application claims priority from U.S. Provisional Application No. 60/727,547 filed Oct. 18, 2005.

FIELD OF THE INVENTION

The invention relates to a laboratory film applicator for use in applying films such as liquid organic polymers (e.g., architectural coatings such as paint), emulsions, adhesives and/or resins to a flat substrate such as paper/cardboard opacity and general test charts, steel panels, glass plates, etc.

BACKGROUND AND SUMMARY OF THE INVENTION

It has long been known in the film applicator art to provide a means for periodic removal and reattachment of adjustable applicator blades for purposes of cleaning and repair of the blades, as well as for substitution of different blades directed to job-specific tasks. An attachment mechanism used for this purpose is required to be relatively uncomplicated, inexpensive and easy to use, yet allows precise and reproducible orientation of the blade relative to the substrate so as to produce a uniform film on the substrate. The mechanism also should be resistant to jamming and clogging in job environments typically encountered in the applicator arts. For example, forming polymeric, paint or adhesive films on a substrate can, over time, result in debris accumulation on the applicator, including within the blade attachment mechanism. This in turn can cause the attachment mechanism to malfunction and result in downtime and lost production while the mechanism is cleaned.

Known blade attachment mechanisms include spring loaded inserts connecting the blade to the applicator frame. While functional in many respects, the inserts are subject to clogging, rusting, breakage and corrosion and are expensive and time consuming to repair and replace.

There is therefore a need in the art for a blade attachment mechanism having a reduced tendency to clog. There is also a need in the art for a blade attachment mechanism which is less expensive to manufacture and less complicated to use compared to known blade attachment mechanisms. These needs are met by the present invention, which provides for magnets, such as rare earth magnets, which secure the blade to an applicator frame.

BRIEF DESCRIPTION OF THE DRAWINGS

For a fuller understanding of the invention, the following detailed description should be read in conjunction with the drawings, wherein.

DETAILED DESCRIPTION

Figure 1:
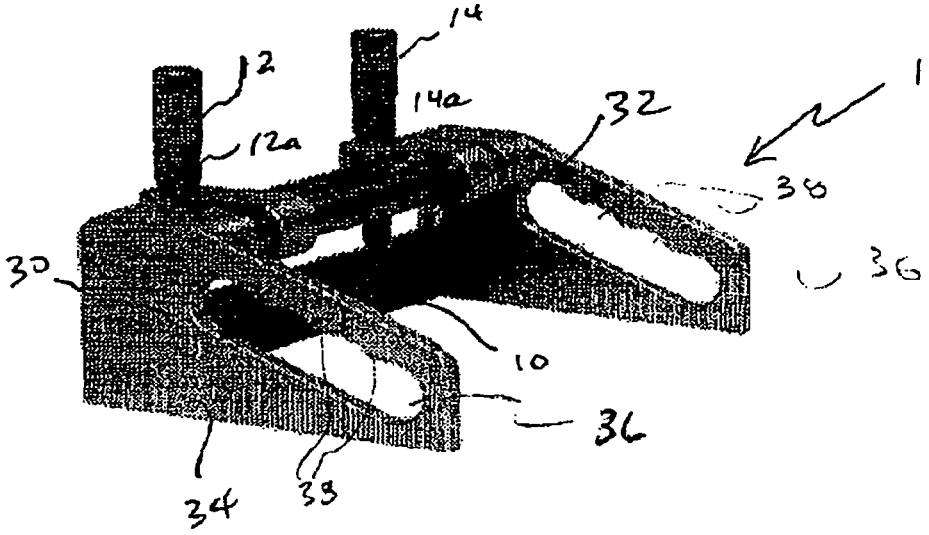
FIG. 1 is a perspective view of one embodiment of the invention.

In order to overcome the deficiencies of the prior art, the present invention provides for a blade attachment mechanism utilizing a plurality of magnets for attaching an applicator blade to an applicator. Typically, applicators used in laboratory settings include a mechanism such as a micrometer to provide precise adjustment and positioning of the applicator blade relative to a substrate. In a particular embodiment of the invention, illustrated in FIGS. 1 and 2, a film applicator is designated generally by the number 1. A blade 10 is secured to tandem micrometers 12, 14 having shafts 12*a*, 14*a* by means of a sleeve 16 into which magnets 18, 20 are press fitted. The sleeve 16 is preferably constructed of a polymeric material such as Delrin® 511P. Delrin is an acetal homopolymer manufactured by E. I. Du Pont de Nemours and is particularly preferred because it is easy to machine and is corrosion resistant. Other materials for sleeve 16 can also be used provided that they enable frictional or press fit of magnets 18, 20.

Magnets 18, 20 magnetically engage steel pin heads 22, 24 imbedded in the blade 10, thereby securing the blade 10 to the applicator 1. This allows for the micrometer shafts 12*a*, 14*a* to be adjusted via the micrometer (not shown), thus moving the magnetically attached blade 10 incrementally in an upward or downward position. This further allows for easy blade detachment for cleaning purposes or blade edge reversal with easy accurate replacement.

In a preferred embodiment, pin heads 22, 24 are constructed of high chromium 400 series stainless steel, such as 416 stainless steel. Also preferably, the pin heads are slightly curved to allow easy disengagement from the magnets 18, 20 while still retaining enough surface area in contact with the magnets to securely hold the blade in place. Other materials for the pins could be substituted depending on the application provided that there is adequate magnetic attraction to the magnets 18, 20.

The blade may be constructed of austenic steel, including 300 series stainless steels. Suitably the steel is magnetic, such as 303 or 306 stainless, with 306 stainless being preferred. The particular selection of the blade material is, however, a choice of the skilled artisan.

Figure 2:
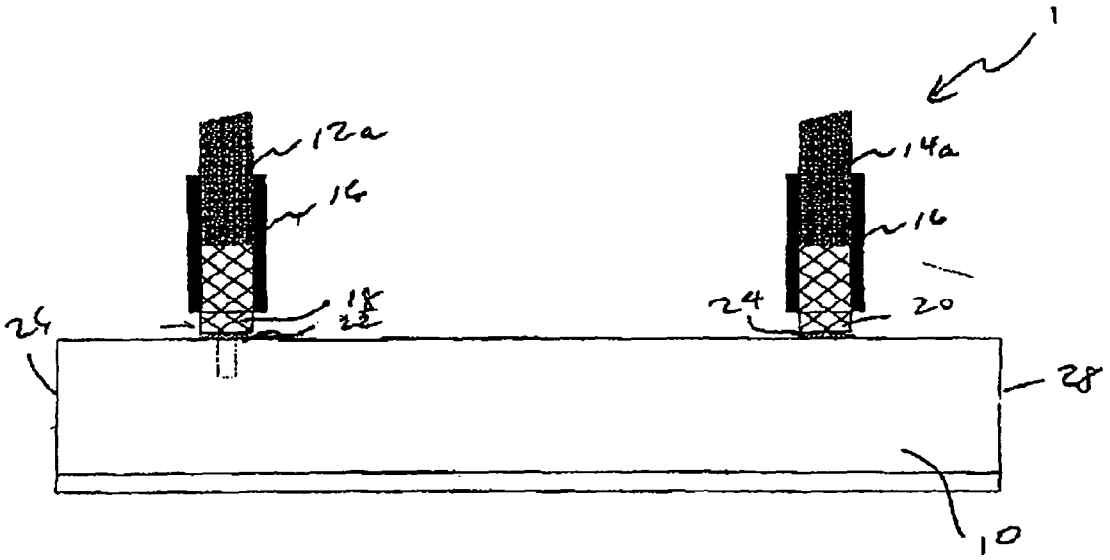
FIG. 2 is a partial cross-sectional, side elevation view of the embodiment of FIG. 1.

As shown particularly in FIG. 1, ends 26, 28 of blade 10 register with channels 30, 32 of applicator housing 34 to restrict lateral movement of the blade. When the blade is removed for cleaning or replacement, it is disengaged from the magnets by the application of force in a direction opposite the magnets and pulled out of channels 30, 32, leaving the channels and the magnets readily accessible for cleaning.

FIG. 1 also illustrates grip handles 36 for gripping the applicator when applying a film. Indentations 38 are preferably provided on the grip handles to facilitate gripping with hands.

What is claimed is:

1. A film applicator, comprising:

an applicator housing;

an applicator blade positioned within said housing;

a micrometer secured to said applicator housing and having a plurality of shafts;

a plurality of magnets each having one end secured to a respective micrometer shaft by a coupling and another end in releasable magnetic engagement with said applicator blade.

2. A film applicator as claimed in claim 1, wherein said coupling comprises a polymeric material in frictional engagement with a respective said magnet.

3. A film applicator as claimed in claim 1, further comprising at least one channel positioned in said applicator housing and slidably engagable with an end of said blade.

4. A film applicator as claimed in claim 3, wherein a said channel is positioned on each of opposite ends of said applicator housing for slidable engagement of opposite ends of said blade.

5. A film applicator as claimed in claim 1, wherein said blade includes pin heads imbedded in said blade and registering with respective magnets for said releasable magnetic engagement.

6. A film applicator as claimed in claim 3, wherein said blade includes pin heads imbedded in said blade and registering with respective magnets for said releasable magnetic engagement.

7. A film applicator as claimed in claim 4, wherein said blade includes pin heads imbedded in said blade and registering with respective magnets for said releasable magnetic engagement.

8. A film applicator as claimed in claim 7, wherein said coupling comprises a polymeric material in frictional engagement with a respective said magnet.

9. A film applicator as claimed in claim 1, including handles for gripping said applicator when applying a film.

10. A film applicator, comprising:

an applicator housing;

an applicator blade positioned within said housing;

a micrometer secured to said applicator housing and having a plurality of shafts;

a plurality of magnets each having one end secured to a respective micrometer shaft and another end in releasable magnetic engagement with said applicator blade, wherein said blade includes pin heads imbedded in said blade and registering with respective magnets for said releasable magnetic engagement.

11. A film applicator as claimed in claim 10, including handles for gripping said applicator when applying a film.

* * * * *